US009722340B2

(12) United States Patent
Kato et al.

(10) Patent No.: US 9,722,340 B2
(45) Date of Patent: Aug. 1, 2017

(54) ELECTRIC WIRE CONNECTOR STRUCTURE

(71) Applicant: Yazaki Corporation, Minato-ku, Tokyo (JP)

(72) Inventors: Hajime Kato, Kakegawa (JP); Takaaki Miyajima, Kakegawa (JP); Takeshi Innan, Kakegawa (JP)

(73) Assignee: Yazaki Corporation, Minato-ku, Tokyo (JP)

( * ) Notice: Subject to any disclaimer, the term of this patent is extended or adjusted under 35 U.S.C. 154(b) by 0 days.

(21) Appl. No.: 14/786,566

(22) PCT Filed: Apr. 23, 2014

(86) PCT No.: PCT/JP2014/061495

§ 371 (c)(1),
(2) Date: Oct. 23, 2015

(87) PCT Pub. No.: WO2014/175360

PCT Pub. Date: Oct. 30, 2014

(65) Prior Publication Data

US 2016/0072211 A1 Mar. 10, 2016

(30) Foreign Application Priority Data

Apr. 24, 2013 (JP) ..... 2013-091820

(51) Int. Cl.
*H01R 13/627* (2006.01)
*H01R 13/42* (2006.01)
(Continued)

(52) U.S. Cl.
CPC ..... *H01R 13/42* (2013.01); *H01R 13/6596* (2013.01); *H01R 13/748* (2013.01); *H01R 24/86* (2013.01)

(58) Field of Classification Search
CPC ..... H01R 13/6275; H01R 13/65802
(Continued)

(56) References Cited

U.S. PATENT DOCUMENTS 8,496,491 B2 7/2013 Baek et al.
9,083,107 B2 7/2015 Suzuki et al.
(Continued)

FOREIGN PATENT DOCUMENTS

JP H06-064381 A 3/1994
JP 2008-041396 A 2/2008
(Continued)

OTHER PUBLICATIONS

Jun. 24, 2014—International Search Report—Intl App PCT/JP2014/061495.
(Continued)

*Primary Examiner* — Phuongchi T Nguyen
(74) *Attorney, Agent, or Firm* — Banner & Witcoff, Ltd.

(57) ABSTRACT

A connector structure includes a plurality of terminals to be connected to an electric wire, an electronic component configured to control an external component to be connected to the terminals, and a housing holding the terminals and the electronic component to accommodate the terminals and the electronic component. Each terminal includes a connection portion to be connected to the electric wire, and an extension portion having a cross section of an arc shape and extending from the connection portion. The housing is configured to hold the plurality of terminals and the electronic component such that the cross sections of the extension portions are arranged to form a substantially circular shape that surrounds the electronic component.

2 Claims, 4 Drawing Sheets

(51) Int. Cl.
*H01R 13/6596* (2011.01)
*H01R 13/74* (2006.01)
*H01R 24/86* (2011.01)

(58) Field of Classification Search
USPC ..... 439/353, 352, 358, 327, 326, 350, 939
See application file for complete search history.

(56) References Cited

U.S. PATENT DOCUMENTS

| | | | | |
|---|---|---|---|---|
| 2012/0100753 | A1* | 4/2012 | Omae ..... | H01R 13/5202<br>439/588 |
| 2012/0171882 | A1 | 7/2012 | Baek et al. | |
| 2014/0106588 | A1 | 4/2014 | Suzuki et al. | |

FOREIGN PATENT DOCUMENTS

| | | | |
|---|---|---|---|
| JP | 2012-142209 | A | 7/2012 |
| JP | 2013-008513 | A | 1/2013 |

OTHER PUBLICATIONS

Jun. 24, 2014—(WO) Written Opinion of the ISA—App PCT/JP2014/061495, Eng Tran.

* cited by examiner

ELECTRIC WIRE CONNECTOR STRUCTURE

TECHNICAL FIELD

The present invention relates to a connector structure for connecting a plurality of electric wire conductors to a connection counterpart device.

BACKGROUND ART

In a vehicle such as an automobile, various electric wires are arranged between various kinds of electric devices. Among the electric devices, some devices form high-voltage circuits, and such high-voltage circuits are provided with safety measures for ensuring safety of an operator or a worker and protection of the devices. For example, some connectors for electric wires arranged in such high-voltage circuits have an electronic component for controlling an external component (such as a built-in component of an electric device) connected to the terminals of the electric wires. Patent Document 1 discloses an example of a connector structure having an interlock serving as such an electronic component.

Patent Document 1: JP2013-8513A

SUMMARY OF INVENTION

Problem to be Solved by Invention

When connecting an electric wire, a terminal is connected to a conductor of the electric wire, and through this terminal, the electric wire is electrically connected to a terminal or the like on a side of an electric device (a connection counterpart device). For example, with a connector in which flat-plate terminals (flat tabs) or rod-shaped terminals (round pins) are connected to respective conductors of a plurality of electric wires arranged in parallel, these plurality of terminals are arranged in parallel in a state of facing the terminals or the like on the side of the electric device. Thus, when the electronic component is arranged on the upper side, the lower side, or the lateral side of the terminals arranged in parallel, the size of the connector becomes large in the direction in which the terminals are arranged and further the size of the connector becomes yet larger by the arranging space for the electronic component. When the size of the connector becomes large, the fabrication cost and the weight also increase. Thus, there is a problem in terms of space-saving by size reduction of the connector, cost reduction, and weight reduction.

The present invention has been made in view of the circumstances described above, and a problem to be solved thereby is to achieve size reduction of an electric wire connector structure.

Means for Solving the Problem

In order to solve the problem described above, the present invention is characterized in that a connector structure includes a plurality of terminals to be connected to an electric wire, an electronic component configured to control an external component to be connected to the terminals, and a housing holding the terminals and the electronic component to accommodate the terminals and the electronic component. Each terminal includes a connection portion to be connected to the electric wires and an extension portion having a cross section of an arc shape and extending from the connection portion. The housing holds the plurality of terminals and the electronic component such that the cross sections of the extension portions are arranged to form a substantially circular shape that surrounds the electronic component.

According to this, the extension portions of the plurality of terminals are formed such that each cross section has an arc shape, and the plurality of terminals are arranged such that these cross sections form a substantially circular shape. Thus, a space for arranging the electronic component can be formed between them. By virtue of this, an arrangement space for the electronic component need not separately be provided on the upper side, the lower side, or the lateral side of the terminals, and hence the connector can be downsized. Further, since the extension portion of each terminal is formed in an arc shape, the configuration of the terminal is simplified and hence reduction of the processing cost, the material cost and the like and weight reduction of the connector can be achieved.

In this case, the housing may include a holding portion holding the respective terminals in a separated manner such that the axial centers of the arc shapes of the extension portions coaxially arranged, and a housing portion surrounding outer peripheries of the respective terminals to accommodate the outer peripheries of the respective terminals, and the holding portion may hold the electronic component inside the holding portion.

Advantage of Invention

According to the present invention, size reduction of an electric wire connector structure can be achieved.

EMBODIMENTS OF INVENTION

An electric wire connector structure of the present invention is described below with reference to the accompanying drawings. The present invention relates to a connector structure for electrically connecting a plurality of conductors of one or more electric wires to a connection counterpart device so as to achieve conduction. Possible situations include a case in which each conductor of a plurality of electric wires, like in a cabtire cable, is connected to a connection counterpart device, a case in which a plurality of conductors of one electric wire, like a coaxial electric wire, are connected to a connection counterpart device, and a case in which these electric wires are mixed.

Figure 1:
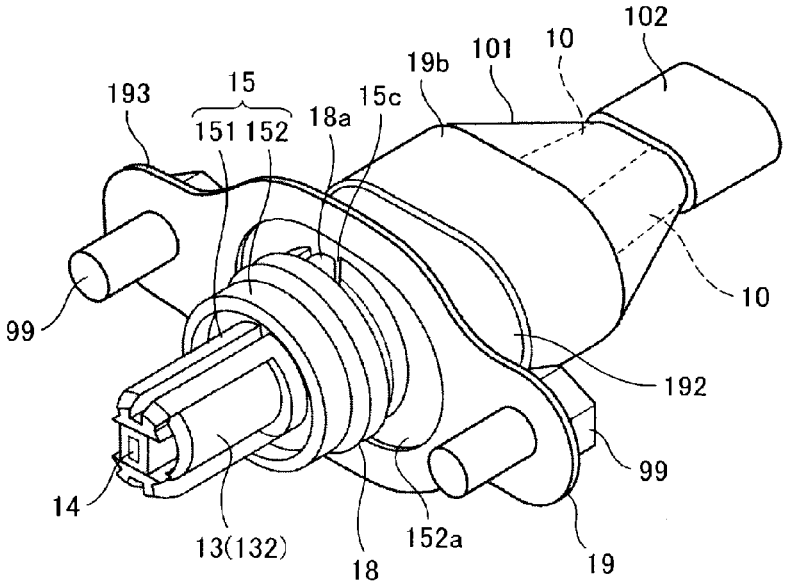
FIG. 1 is a perspective view of an overall connector structure according to a first embodiment of the present invention.
Figure 2:
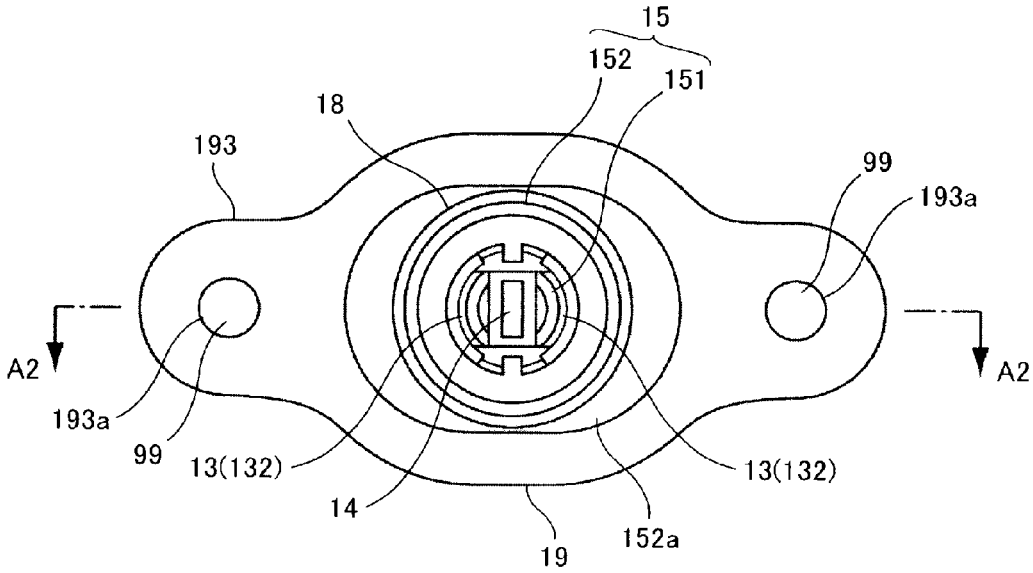
FIG. 2 is a view of the connector structure shown in FIG. 1 viewed from a terminal side.
Figure 3:
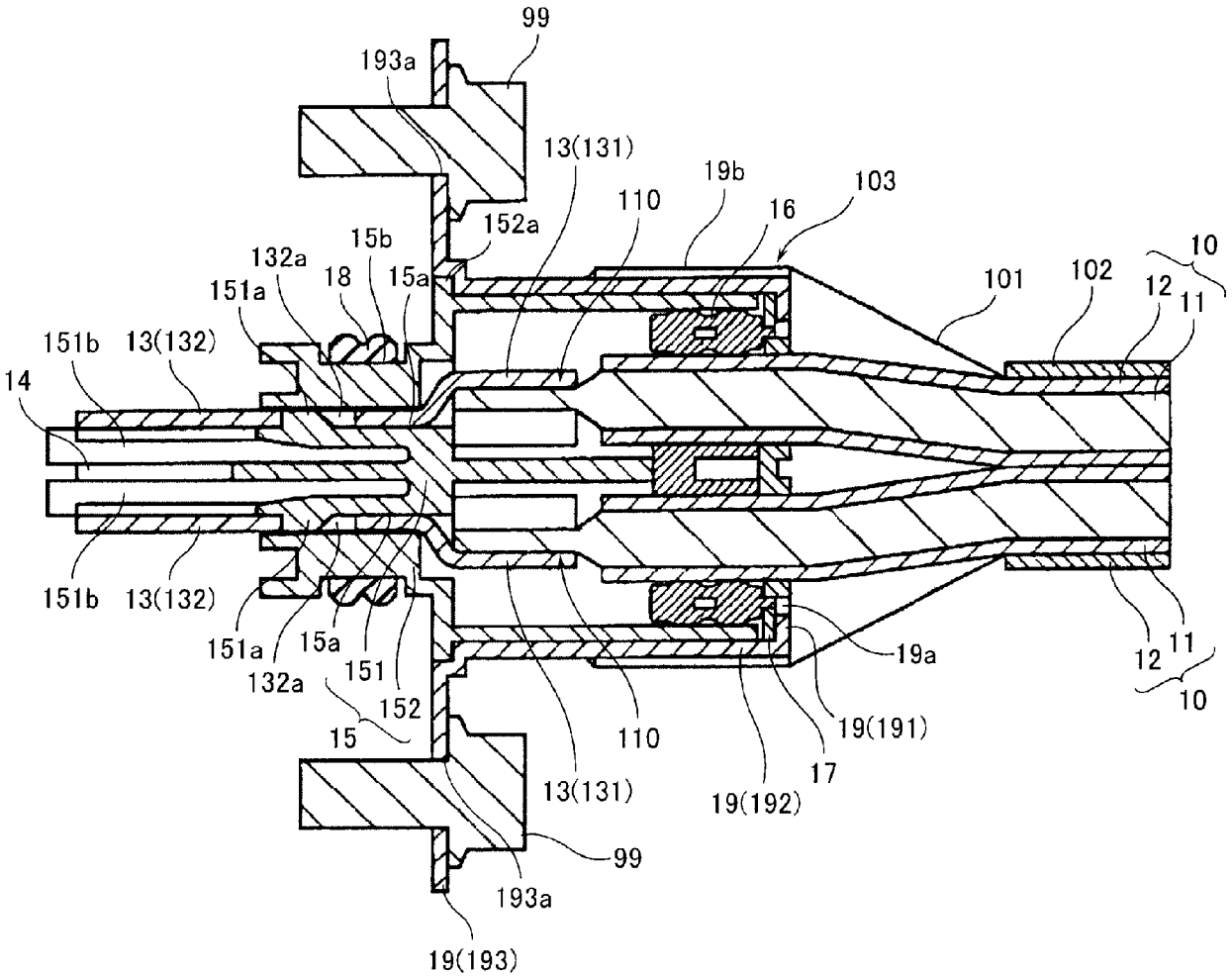
FIG. 3 is a longitudinal sectional view taken along the arrows A2 of FIG. 2 and viewed from the direction of the arrows.

(First Embodiment) FIGS. 1 to 3 illustrate a connector structure according to a first embodiment of the present invention. FIG. 1 is a perspective view of the overall connector structure. FIG. 2 is a view of the connector structure shown in FIG. 1 viewed from the terminal side. FIG. 3 is a longitudinal sectional view taken along the arrows A2 of FIG. 2 and viewed from the direction of the arrows.

As shown in FIGS. 1 to 3, the connector structure according to the present embodiment includes a plurality of terminals 13 to be connected to electric wires 10, an electronic component 14 configured to control an external component to be connected to the terminals 13, and a housing 15 holding the plurality of terminals 13 and the electronic component 14 to accommodate the plurality of terminals 13 and the electronic component 14. In the present embodiment, two terminals 13 are connected one to one to the two electric wires 10 constructed such that a conductor 11 is covered by an insulating cover 12. The two electric wires 10 are enclosed by one shielding conductor (e.g., a braided wire) 101 covered by a protecting sheath 102 and then the connection portion (referred to as a terminal connection portion of the electric wires 10, hereinafter) between each electric wire 10 and the terminal 13 is collectively shielded by the shielding conductor 101. Here, in the following description, in the extending directions (the right and left directions in FIG. 3) of the electric wires 10, the side (the left side in the figure) where the terminals 13 are connected is referred to as a terminal side and the opposite side (the right side in the figure) is referred to as a base end side.

Each terminal 13 is constructed from an electrical conductive plate member, and includes a connection portion 131 connected to a portion (hereinafter, a terminal part,) 110 where the insulating cover 12 is stripped so that the conductor 11 is exposed, and an extension portion 132 having a cross section of an arc shape and extending from the connection portion 131.The connection portion 131 is joined to the terminal part 110 by ultrasonic welding or the like so as to be integrated with the electric wire 10. The extension portion 132 is connected to one of a plurality of terminal members provided in a connection counterpart device (e.g., an electric device mounted on an automobile) of the electric wires 10. In the present embodiment, as an example, a configuration is employed that each extension portion 132 extends in a substantially semi-cylindrical shape having the same curvature. Thus, when the extension portions 132 are arranged such that the axial centers of the substantially semi-cylindrical shapes become coaxial, the two terminals 13 can face each other such as to form together a substantially cylindrical shape. Thus, this avoids a necessity that the size of the connector is enlarged in the arrangement direction of the terminals, which becomes necessary, for example, in a case that two flat-plate terminals (flat tabs) or two rod-shaped terminals (round pins) are arranged in parallel. Further, each terminal 13 need not be formed into a cylindrical shape or the like and hence the configuration can be simplified. Thus, reduction of the process cost, the material cost, and the like can be achieved.

The electronic component 14 is a component for controlling the external component connected to the terminals 13. For example, it may be premised that such an external component is a component of diverse kind that forms an electric circuit between the electric wires 10 (the terminals 13) and the connection counterpart device. Then, as the electronic component 14 for controlling such an external component, the connector structure according to the present embodiment includes an interlock. For example, the interlock 14 includes two interlock terminals. Then, when the terminals 13 are positioned into a normal fitting state relative to the terminal members of the connection counterpart device, a short terminal provided in the connection counterpart device connects two interlock terminals so as to realize a state that a predetermined circuit (an interlock circuit) is closed. On the other hand, in a case that the terminals 13 and the terminal members of the connection counterpart device are not positioned in a normal fitting state, the interlock terminals are not connected to the short terminal and hence the interlock circuit remains in an open state. Thus, when a situation that the interlock circuit is closed is sensed by sensing means or the like provided in the connection counterpart device, a situation can be sensed that the terminals 13 and the terminal members of the connection counterpart device are normally fit in (connected), that is, electrical conduction between these can be achieved. In contrast, when a situation is sensed that the interlock circuit is open, action can be taken like the terminals 13 are re-connected to the terminal members of the connection counterpart device.

The terminals 13 and the interlock 14 are held in the housing 15. The housing 15 holds the terminals 13 and the interlock 14 such that the cross sections of the individual extension portions 132 of the two terminals 13 are aligned to each other in a substantially circular shape enclosing the interlock 14. That is, the two extension portions 132 are arranged by the housing 15 such that the axial centers of the substantially semi-cylindrical shapes become coaxial. Thus, the extension portions 132 can face to each other in a substantially cylindrical shape. By virtue of this, a space used for arranging the interlock 14 can be formed between the two extension portions 132.

The housing 15 includes a holding portion 151 holding the two terminals 13 separately from each other such that the axial centers of the substantially semi-cylindrical shapes are coaxially arranged so that the extension portions 132 are opposed to each other as described above and holding the interlock 14 on an inner side of the opposed extension portions 132 facing, and a housing portion 152 surrounding the outer periphery of the terminals 13 held by the holding portion 151 (in other words, the terminal connection portions of the electric wires 10) to accommodate the outer peripheries of the terminals 13. When the connector structure is viewed from the terminal side as shown in FIG. 2, the holding portion 151 and the housing portion 152 are substantially circular and arranged coaxial to the axial centers of the extension portions 132 of the two terminals 13. Between the holding portion 151 and the housing portion 152, an opening part 15*a* is formed that allows the extension portions 132 to be exposed to the outside.

The holding portion 151 holds the extension portions 132 inserted through the opening part 15*a* and then exposed to the outside, along the extending direction. By virtue of this, the extension portions 132 are positioned in a manner of being connectable to the terminal members of the connection counterpart device. Further, the holding portion 151 holds the interlock 14 inside the center part (on an inner side of the extension portions 132 having been held) of the holding portion 151 such that the interlock 14 is faced to the outside. By virtue of this, the interlock 14 is positioned in a manner of being connectable to the short terminal and the like of the connection counterpart device.

The holding portion 151 is provided with engaging protrusions 151*a* capable of engaging with engagement holes 132*a* formed in the extension portions 132. The engaging protrusion 151*a* is provided in and protrudes from a flexible arm extending in a cantilever manner along a clearance groove 151*b*. When holding the terminals 13 in the housing 15 to accommodate the terminals 13, the engaging protrusion 151*a* abuts against the inner peripheral surface of the extension portion 132 and thereby suffers elastic warp deformation such as to fall into the clearance groove 151*b*. Then, when the engaging protrusion 151*a* has moved along the inner peripheral surface to the engagement hole 132*a*, the engaging protrusion 151*a* performs elastic warp restoration deformation such as to spread outward (a radially expanding direction) so as to engage with the engagement hole 132*a*. As a result, the terminals 13 are positioned and held by the holding portion 151 and then the outer periphery side of the terminals 13 is enclosed by the housing portion 152. By virtue of this, in the housing 15, the two terminals 13 can be arranged separate from and coaxial to each other by the holding portion 151 and the terminals 13 can be accommodated in the housing portion 152. In this case, the holding portion 151 may have a configuration that a protrusion is provided that, when the engaging protrusion 151*a* engages with the engagement hole 132*a*, abuts against and interferes with the tip part of the extension portion 132. In a case that such a protrusion is provided, when placing the terminals 13 in the housing 15, the extension portion 132 can be positioned in a state of being appropriately exposed through the opening part 15*a* by sliding the extension portion 132 along the holding portion 151 until the extension portion 132 abuts against the protrusion.

Here, when placing the terminals 13 into the housing 15, the connection portions 131 of the terminals 13 are connected to the terminal parts 110 of the conductor 11, and the terminals 13 and the housing 15 are moved relative to each other in a state in which the extension portions 132 of the terminals 13 are inserted into the opening part 15*a*. In this case, a hermetic seal member (referred to as a seal rubber, hereinafter) 16 for preventing entering of water from the base end side to the terminal connection portion is mounted on the electric wires 10. The seal rubber 16 is formed from an elastic material such as rubber and resin and is held by a holder member (referred to as a seal rubber holder, hereinafter) 17 In this case, the seal rubber holder 17 is mounted on the base end side (the right side in FIG. 3) of the electric wires 10 relative to the seal rubber 16 and then the seal rubber 16 is brought into close contact with the terminal side (the left side in the figure) of the seal rubber holder 17 so that the seal rubber 16 is positioned and held. By virtue of this, the seal rubber 16 is located between the insulating cover 12 and the housing portion 152 and between the two electric wires 10 so as to seal between these. At the same time, the seal rubber 16 together with the seal rubber holder 17 closes through holes 19*a* of a shield shell 19 described later. Here, in the present embodiment, the seal rubber holder 17 is constructed separately from the seal rubber 16. Instead, a configuration may be employed that these components are formed integrally.

Further, in the housing 15, a mounting groove 15*b* is formed that is used for mounting a hermetic seal member (referred to as a packing, hereinafter) 18 for preventing entering of water from the terminal side to the terminal connection portion of the electric wires 10. The packing 18 mounted in the mounting groove 15*b* is located between the frontage (not shown) of the connection counterpart device and the housing portion 152 and thereby seals between these. In this case, the packing 18 is provided with a rotation preventing piece 18*a* and then the rotation preventing piece 18*a* is inserted into a fitting part 15*c* formed in the mounting groove 15*b* and thereby interferes so that stop of rotation relative to the housing 15 is achieved.

In the housing 15 in which the terminals 13 are arranged, the outer periphery of the housing portion 152 is enclosed by the shield shell 19. The shield shell 19 includes a bottom part 191 provided with through holes 19*a* through which the two electric wires 10 are respectively inserted, a tubular wall 192 extending from the bottom part 191 to the terminal side, and a fixing part 193 extending outward flatly from the wall 192. In the shield shell 19, the two electric wires 10 are inserted from the terminal side into the through holes 19*a* of the bottom part 191 in advance, before the terminals 13 are arranged in the housing 15. During the work of placing the terminals 13 in the housing 15, the shield shell 19 is retracted to the base end side relative to the terminal parts 110 of the conductors 11. Then, the terminals 13 are connected to the conductors 11 so that the terminals 13 are contained into the housing 15, after that, the shield shell 19 is moved to the terminal side along the electric wires 10 inserted into the through holes 19*a*, and the tip of the wall 192 is abut against and engaged with a flange part 152*a* provided such as to extend outward flatly from the housing portion 152. By virtue of this, the shield shell 19 can be positioned relative to the electric wires 10.

The shield shell 19 is connected to a portion (a terminal part) 103 where the protecting sheath 102 is stripped so that the shielding conductor 101 is exposed. In this case, the terminal part 103 of the shielding conductor 101 is arranged and placed on the outer periphery of the wall 192 and then the terminal part 103 is pressure-connected to the outer periphery of the wall 192 by using a ring member (a shield ring) 19*b* crowned on the outer periphery. Then, the shield shell 19 is fixed to fixing members (not shown) of the connection counterpart device by using fixing members (bolts and the like) 99 inserted into fixation holes 193*a* punched in the fixing part 193, so that the shielding conductor 101 is grounded through the connection counterpart device and thereby shield processing for the electric wires 10 is achieved.

As described above, according to the connector structure according to the present embodiment, the extension portions 132 of a plurality (two, as an example) of the terminals 13 are formed in an arc shape (a substantially semi-cylindrical shape, as an example) and then the plurality of terminals 13 are arranged opposite to each other such that these may form a substantially cylindrical shape. Thus, a space used for arranging the interlock 14 can be formed between these. By virtue of this, an arrangement space for the interlock 14 need not separately be ensured on the upper side, the lower side, the lateral sides, or the like of the terminals 13 and hence size reduction of the connector can be achieved. Further, since the extension portion 132 of each terminal 13 is formed in an arc shape (a substantially semi-cylindrical shape, as an example), the configuration of the terminal 13 can be simplified and hence reduction of the process cost, the material cost, and the like and weight reduction of the connector can be achieved.

In the first embodiment described above, a configuration has been employed that the interlock 14 is provided as the electronic component. However, it is sufficient that the electronic component is a component for controlling an external component connected to the terminals. That is, a component other than the interlock 14 may be employed. For example, even when a connector structure is employed that a fuse is provided as the electronic component, a similar operation effect to that of the first embodiment can be achieved. A connector structure obtained by changing into this configuration is described below as a second embodiment of the present invention. Here, in the second embodiment, the same or similar component members to those of the first embodiment described above are designated by the same numerals in the drawings and then description is omitted or simplified. Thus, the following description is given for differences from the first embodiment.

Figure 4:
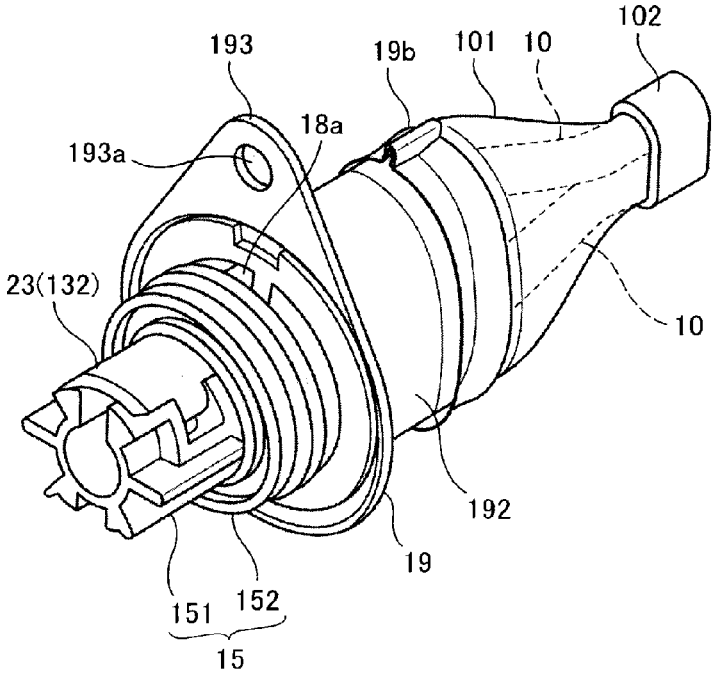
FIG. 4 is a perspective view of an overall connector structure according to a second embodiment of the present invention.
Figure 5:
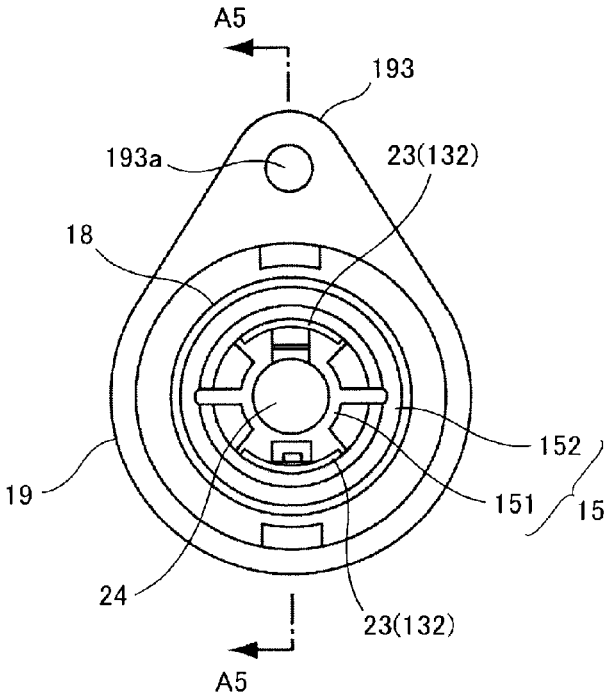
FIG. 5 is a view of the connector structure shown in FIG. 4 viewed from a terminal side.
Figure 6:
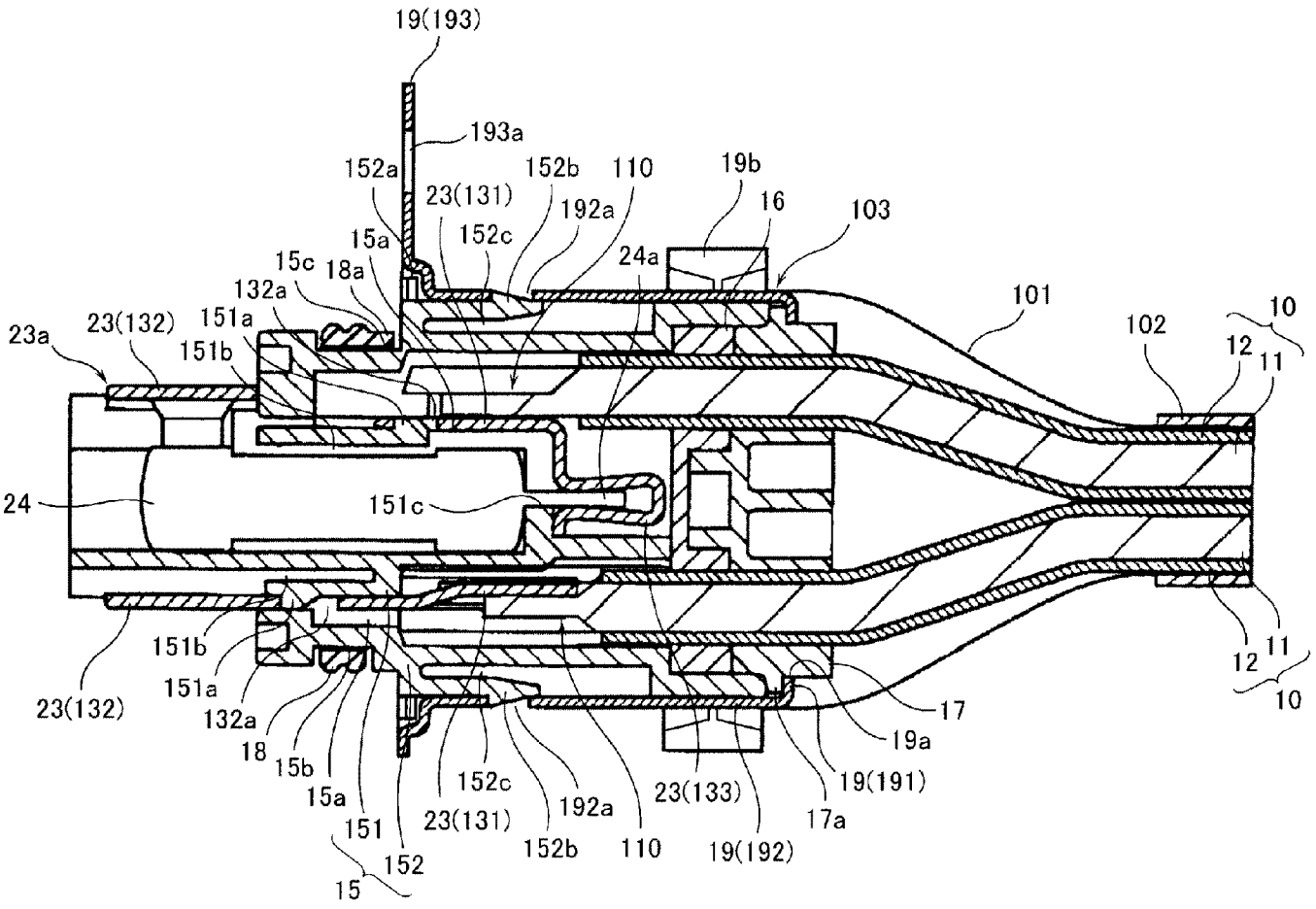
FIG. 6 is a longitudinal sectional view taken along the arrows A5 of FIG. 5 and viewed from the direction of the arrows.

(Second Embodiment) FIGS. 4 to 6 illustrate a connector structure according to a second embodiment of the present invention. FIG. 4 is a perspective view of the overall connector structure. FIG. 5 is a view of the connector structure shown in FIG. 4 viewed from the terminal side. FIG. 6 is a longitudinal sectional view taken along the arrows A5 of FIG. 5 and viewed from the direction of the arrows.

As shown in FIGS. 4 to 6, in the present embodiment, two terminals 23 are connected one to one to the two electric wires 10. Then, when the extension portions 132 are arranged coaxial to each other, these terminals 23 can face to each other such as to form together a substantially cylindrical shape. By virtue of this, a space used for arranging an electronic component (a fuse) 24 is formed between the two terminals 23 and then, in the space, the fuse 24 is held by the holding portion 151 of the housing 15.

One terminal 23*a* (the upper one in FIG. 6) among the two terminals 23 includes a bent part 133 in addition to the connection portion 131 and the extension portion 132. The bent part 133 is formed continuously to the connection portion 131 toward a side opposite to the extension portion 132 and is connected to the fuse 24. In the present embodiment, the bent part 133 is formed in a clip shape such as to pinch a fuse terminal 24*a* attached to the fuse 24. However, the shape of the bent part is not limited to this as long as connection to the fuse 24 (the fuse terminal 24*a*) is achievable.

The fuse 24 held inside the center part (on an inner side of the extension portions 132) of the holding portion 151 and then the fuse terminal 24*a* inserted into a through hole 151*c* formed in the holding portion 151 is pinched by the bent part 133. By virtue of this, the fuse 24 is connected through the fuse terminal 24*a* and the terminal 23 (23*a*) to the electric wire 10. As such, since the fuse 24 is connected to a circuit formed between the terminals 23 of the two electric wires 10 and the connection counterpart device, when an over-current flows, the circuit can be shut down so that protection of the connection counterpart device can be achieved. That is, in the present embodiment, a safety function by the fuse 24 is imparted to the connector structure.

The two terminals 23 arranged in this way are housed, together with the fuse 24, in the housing 15 in a separate manner in a state that the axial centers of the substantially semi-cylindrical shapes are coaxial to each other. Here, the two terminals 23 are positioned such that the extension portions 132 can be connected to the terminal members of the connection counterpart device. Further, the fuse 24 is positioned such that the connection portion on a side opposite to the fuse terminal 24*a* can be connected to the internal circuit or the like of the connection counterpart device. Further, a situation that sealing between the insulating cover 12 and the housing portion 152 and between the two electric wires 10 is achieved by the seal rubber 16 and sealing between the frontage (not shown) of the connection counterpart device and the terminal housing portion 142 is achieved by the packing 18 so that entering of water into the terminal connection portion of the electric wires 10 is prevented is similar to the first embodiment.

In the housing 15 in which the terminals 23 are arranged, the outer periphery of the housing portion 152 is enclosed by the shield shell 19 and then the terminal part 103 of the shielding conductor 101 is pressure-connected to the shield shell 19 by using a shield ring 19*b*. In this case, engagement holes 192*a* capable of engaging with engaging protrusions 152*b* provided in the housing portion 152 of the housing 15 are formed in the wall 192. The engaging protrusion 152*b* is provided in and protrudes from a flexible arm extending in a cantilever manner along a clearance groove 152*c*. By virtue of this, when the shield shell 19 is fit onto the outer periphery of the housing portion 152 from the base end side and then the engaging protrusions 152*b* are engaged with the engagement holes 192*a*, the shield shell 19 can be positioned and fixed to the housing 15, strictly, to the electric wires 10. Further, a projected rim part 17*a* formed in the outer periphery of the seal rubber holder 17 engages with the bottom part 191. This also permits positioning of the shield shell 19.

Here, in the first embodiment (FIGS. 1 to 3) and the second embodiment (FIGS. 4 to 6) described above, a configuration has been employed that the two terminals 13 are connected one to one to the two electric wires 10. However, a connector structure may be employed that a plurality of terminals are connected one to one to three or more electric wires. For example, in a connector structure constructed such that the three terminals are connected one to one to three electric wires, a configuration may be employed that the extension portion of each terminal is formed in an arc shape having the same curvature and then these extension portions are arranged coaxial to each other at the same intervals (a phase difference of 120°) so as to be aligned in a substantially cylindrical shape. In short, the number of terminals (in other words, the number of electric wires) is not particularly limited and may be set optionally in so far as the extension portions of a plurality of terminals are formed such that the cross sections have arc shapes and then the plurality of terminals are arranged such that the extension portions form a substantially cylindrical shape (the cross sections form a substantially circular shape) so that a space arranging an electronic component such as an interlock and a fuse can be formed between the extension portions.

Here, the features of the embodiments of the electric wire connector structure according to the present invention described above are briefly listed below in the following [1] and [2].

[1] An electric wire connector structure including a plurality of terminals (13) to be connected to an electric wire (10), an electronic component (an interlock 14) configured to control an external component to be connected to the terminals, and a housing (15) holding the terminals and the electronic component to accommodate the terminals and the electronic component, wherein each terminal includes a connection portion (131) to be connected to the electric wire, and an extension portion (132) having a cross section of an arc shape and extending from the connection portion, and wherein the housing holds the plurality of terminals and the electronic component such that the cross sections of the extension portions are arranged to form a substantially circular shape that surrounds the electronic component.

[2] The electric wire connector structure according to [1] described above, wherein the housing includes a holding portion (151) holding the respective terminals in a separated manner such that the axial centers of the arc shapes of the extension portions are coaxially arranged, and a housing portion (152) surrounding outer peripheries of the respective terminals to accommodate the outer peripheries of the respective terminals, and wherein the holding portion holds the electronic component inside the holding portion.

The present invention has been described in detail with reference to particular embodiments. However, it is clear for the person skilled in the art that various modifications and corrections may be made without departing from the spirit and the scope of the present invention.

The present application is based on Japanese Patent Application No. 2013-91820 filed on Apr. 24, 2013, the content of which is incorporated herein by reference.

INDUSTRIAL APPLICABILITY

According to the present invention, size reduction of an electric wire connector structure can be achieved. The present invention having this effect is useful as a connector structure for connecting a plurality of conductors of electric wires to a connection counterpart device.

DESCRIPTION OF REFERENCE SIGNS

10 Electric wires
13 Terminals
14 Electronic component (interlock)
15 Housing
24 Electronic component (fuse)
131 Connection portion
132 Extension portion

The invention claimed is:

1. An electric wire connector structure comprising:
a plurality of terminals to be connected to an electric wire,
an electronic component configured to control an external component to be connected to the terminals, and
a housing holding the terminals and the electronic component to accommodate the terminals and the electronic component,
wherein each of the terminals comprises
a connection portion to be connected to the electric wire, and
an extension portion having a cross section of an arc shape and extending from the connection portion, and
wherein the housing holds the plurality of terminals and the electronic component such that the cross sections of the extension portions of the plurality of terminals are arranged to together form a substantially circular shape that surrounds the same electronic component.

2. The electric wire connector structure according to claim 1,
wherein the housing comprises
a holding portion holding the respective terminals in a separated manner such that axial centers of the arc shapes of the extension portions coaxially arranged, and
a housing portion surrounding outer peripheries of the respective terminals to accommodate the outer peripheries of the respective terminals, and
wherein the holding portion holds the electronic component inside the holding portion.

* * * * *